US010330313B2

(12) United States Patent
Huang

(10) Patent No.: US 10,330,313 B2
(45) Date of Patent: Jun. 25, 2019

(54) TWIRLING FLAME HEATER

(71) Applicant: WELL TRAVELED IMPORTS, INC., Amelia Island, FL (US)

(72) Inventor: Xuefeng Huang, Changzhou (CN)

(73) Assignee: Well Traveled Imports INC, Amelia Island, FL (US)

( * ) Notice: Subject to any disclaimer, the term of this patent is extended or adjusted under 35 U.S.C. 154(b) by 298 days.

(21) Appl. No.: 15/298,562

(22) Filed: Oct. 20, 2016

(65) Prior Publication Data

US 2018/0010790 A1 Jan. 11, 2018

(30) Foreign Application Priority Data

Jul. 11, 2016 (CN) ..... 2016 2 0726927 U

(51) Int. Cl.

| | |
|---|---|
| ***F23D 14/10*** | (2006.01) |
| ***F23D 14/12*** | (2006.01) |
| ***F23C 3/00*** | (2006.01) |
| ***F23C 7/00*** | (2006.01) |

(52) U.S. Cl.

CPC ..... *F23D 14/10* (2013.01); *F23C 3/002* (2013.01); *F23C 3/006* (2013.01); *F23C 7/004* (2013.01); *F23D 14/12* (2013.01)

(58) Field of Classification Search

CPC ..... F24H 3/0417; F24H 9/2085; F24H 3/065; F24H 3/006; F23D 14/10

See application file for complete search history.

(56) References Cited

U.S. PATENT DOCUMENTS 1,484,156 A * 2/1924 Phelan ..... F24C 7/065 200/220
1,636,597 A * 7/1927 Fischer ..... F23D 11/10 239/404
1,841,940 A * 1/1932 Eklund ..... C04B 11/028 432/210
1,862,910 A * 6/1932 Schutz ..... F23D 5/00 431/117
2,804,031 A * 8/1957 Douglass, Jr. ..... F23G 5/32 110/120
3,087,796 A * 4/1963 Latham, Jr. ..... C09C 1/50 422/150
3,187,799 A * 6/1965 Nesbitt ..... F23C 3/002 236/15 R (Continued)

FOREIGN PATENT DOCUMENTS

CN 204043050 12/2014
DE 3639105 A1 5/1991

OTHER PUBLICATIONS

International Search Report accompanied with search history for PCT/US2016/67858, dated Dec. 8, 2017.
PCT Int'l Search Report, dated Jan. 15, 2019, Mineko Mohri.

*Primary Examiner* — Jorge A Pereiro
(74) *Attorney, Agent, or Firm* — Lau & Associates, LLC

(57) ABSTRACT

This is an upright heater igniting combustible gas to induce a naturally aspirated flame within a glass tube. Air channels producing the naturally aspirated flame enters the glass tube in a direction perpendicular to the direction of the flame thus creating a twirling flame. Heat waves generated by the twirling flame within a glass tube rises to a heat concentrator and projected onto a parabolic heat shield thus reflecting the heat wave radially downward and outward.

19 Claims, 14 Drawing Sheets

(56) References Cited

U.S. PATENT DOCUMENTS 3,244,220 A * 4/1966 Kloecker ..... F23D 11/00 110/244
3,273,623 A * 9/1966 Nesbitt ..... F23C 3/002 431/349
3,494,599 A * 2/1970 Jones ..... F23D 11/10 431/88
3,706,446 A * 12/1972 Briggs ..... F24H 3/04 432/224
3,746,499 A 7/1973 Guerre et al.
3,771,942 A * 11/1973 Sohnchen ..... F23Q 3/002 431/255
4,060,369 A * 11/1977 Schoute ..... F23C 3/002 126/91 A
4,147,115 A * 4/1979 Leppert ..... F23G 5/16 110/244
4,257,760 A * 3/1981 Schuurman ..... F23C 3/006 431/158
4,532,914 A * 8/1985 Thomas ..... F23D 11/40 126/110 C
4,679,545 A 7/1987 Cavestany
4,984,981 A 1/1991 Pottebaum
5,032,163 A 7/1991 Balestra
5,033,449 A * 7/1991 Hanagan ..... A47J 37/0704 126/25 A
D319,305 S 8/1991 Beavers et al.
5,080,578 A 1/1992 Josephs et al.
D325,963 S 5/1992 Anderson
5,291,943 A * 3/1994 Dhir ..... F28D 3/04 138/38
5,680,765 A * 10/1997 Choi ..... F23C 7/004 239/434
D410,536 S 6/1999 Willey et al.
5,960,783 A * 10/1999 Schubert ..... F24C 3/103 126/41 R
D417,492 S 12/1999 Willey et al.
6,065,468 A 5/2000 Willey et al.
6,138,666 A 10/2000 Hubbard
6,269,755 B1 * 8/2001 Boswell ..... F23C 3/008 110/210
6,338,319 B1 1/2002 Vago
D465,836 S 11/2002 Smith et al.
D470,932 S 2/2003 Smith et al.
D486,567 S 2/2004 Sakai
6,745,759 B2 6/2004 Bossler
6,895,902 B2 5/2005 Kobayashi et al.
6,907,875 B1 6/2005 Eastman, II et al.
D532,501 S 11/2006 Giovino
7,175,424 B2 2/2007 Frink et al.
7,234,255 B2 6/2007 Peng et al.
7,236,693 B2 6/2007 Haugom
7,296,522 B1 11/2007 Hahmalji
D594,949 S 6/2009 Wang
7,654,819 B2 * 2/2010 Okada ..... F23C 3/002 431/173
D619,231 S 7/2010 Yeung
D621,873 S * 8/2010 Tsai ..... D19/26
D622,318 S * 8/2010 Tsai ..... D19/62
D634,412 S 3/2011 Boldsen
D639,919 S 6/2011 Yu
D640,355 S 6/2011 Yu
7,974,526 B2 7/2011 Chu
D669,974 S 10/2012 McNeal
8,312,872 B2 11/2012 Park et al.
8,540,509 B1 9/2013 Cantal
8,613,277 B2 12/2013 Hall, Jr. et al.
8,641,413 B2 * 2/2014 Chen ..... F23D 5/04 431/288
8,677,988 B2 3/2014 Jin
8,776,777 B2 7/2014 Jin et al.
8,863,673 B2 10/2014 Diepenbrock
D718,850 S 12/2014 Stokke
D727,484 S 4/2015 Yang
D754,309 S 4/2016 Yang
D756,496 S 5/2016 Wang
D760,880 S 7/2016 Jenkins
9,404,671 B2 8/2016 Liang
2002/0023636 A1 * 2/2002 Ashton ..... F21H 1/00 126/92 B
2003/0049579 A1 * 3/2003 Hsieh ..... F23D 14/06 431/344
2003/0051480 A1 * 3/2003 Graves ..... F23D 11/14 60/776
2009/0016048 A1 * 1/2009 McBrien ..... F21L 17/00 362/180
2009/0023105 A1 * 1/2009 Yeung ..... F23Q 9/04 431/6
2010/0104993 A1 * 4/2010 Ryser ..... F23D 3/16 431/252
2010/0154779 A1 * 6/2010 Andors ..... A47B 37/04 126/512
2010/0236544 A1 * 9/2010 Hall, Jr. ..... F23D 14/12 126/85 R
2011/0076627 A1 * 3/2011 DiVentura ..... F23C 3/002 431/12
2012/0006316 A1 * 1/2012 Shimek ..... F23C 7/004 126/519
2012/0225391 A1 * 9/2012 Moetteli ..... C11C 5/006 431/126
2012/0263443 A1 * 10/2012 Yen ..... F24H 3/00 392/465
2013/0160756 A1 * 6/2013 Yen ..... F24C 3/14 126/275 R
2013/0160759 A1 * 6/2013 Yen ..... F24C 3/14 126/91 A
2013/0287375 A1 * 10/2013 Hall, Jr. ..... F24D 19/1096 392/407
2014/0290643 A1 * 10/2014 Potter ..... F23C 7/004 126/512
2014/0305427 A1 * 10/2014 Liang ..... F24H 3/006 126/90 R
2014/0305428 A1 * 10/2014 Liang ..... F24H 9/0073 126/91 A
2014/0361660 A1 * 12/2014 Hall, Jr. ..... H02N 11/002 310/300
2015/0354817 A1 12/2015 Fuller et al.
2016/0131394 A1 * 5/2016 Liang ..... F23D 14/82 126/90 R
2016/0348915 A1 * 12/2016 Yang ..... F24C 1/12
2016/0356491 A1 12/2016 Rivera
2017/0211813 A1 * 7/2017 Zoske ..... F23D 5/045
2017/0254533 A1 * 9/2017 Usci ..... F23D 14/06

* cited by examiner

TWIRLING FLAME HEATER

FIELD OF INVENTION

This invention generally relates to a flame heater.

BACKGROUND OF THE INVENTION

Outdoor heaters have become popular in recent years. They have been used in amusement theme parks, sports stadiums, restaurants, sidewalks and residential backyards. In addition to serving as heaters, they also serve as decorative furniture and fixtures.

U.S. Pat. No. D619,231 features on directional heat radiation; U.S. Pat. No. 6,745,759 features a basic utilitarian design; U.S. Pat. No. D718,850 features decorative woven wicker as surface material pleasant to sight and touch; U.S. Pat. No. D634,412 features fancy appearance to make a patio heater a fashion statement in addition to its utility functions; U.S. Pat. No. D486,567 features a tree like design to assimilate surrounding environment; U.S. Pat. No. D634,412 features pyramid shape for aesthetic appeal; U.S. Pat. No. 7,296,522 features a table with an outdoor heater to combine convenience with utility; U.S. Pat. No. D532,501 departs the monotone of a single heater head design by having a double heater head; U.S. Pat. No. 7,175,424 features a twisting flame induced by an electric fan 40 inherent therewith is the danger of leaking combustible gas when flame 15 is extinguished by fan 40.

OBJECT OF THE INVENTION

It is a first object of the present invention to produce a twirling flame heater.

It is a second object of the present invention to produced a twirling flame heater by natural aspiration rather than induced aspiration.

It is a third object of the present invention to enhance the atheistic appeal of a patio heater.

It is a fourth object of the present invention to eliminate a separately powered fan that may inadvertently extinguish a flame.

It is a fifth object of the present invention to prevent leaking combustible gas while in operation.

It is a sixth object of the present invention to prolong the length of time a twirling flame can be sustained by a limited gas supply.

It is a seventh object of the present invention to produce a single flame that twirls.

It is an eighth object of the present invention to eliminate the need to produce two separate flames to induce a flame twirling effect.

It is a ninth object of the present invention to eliminate the need to construct a large patio heater to accommodate two separate flames to achieve the twirling effect.

It is a tenth object of the present invention to increase transportability of a patio heater.

Other objects of the present invention would become self evident upon a review of the following written specification, abstract, drawings and claims.

DETAILED DESCRIPTION OF THE INVENTION

Figure 1:
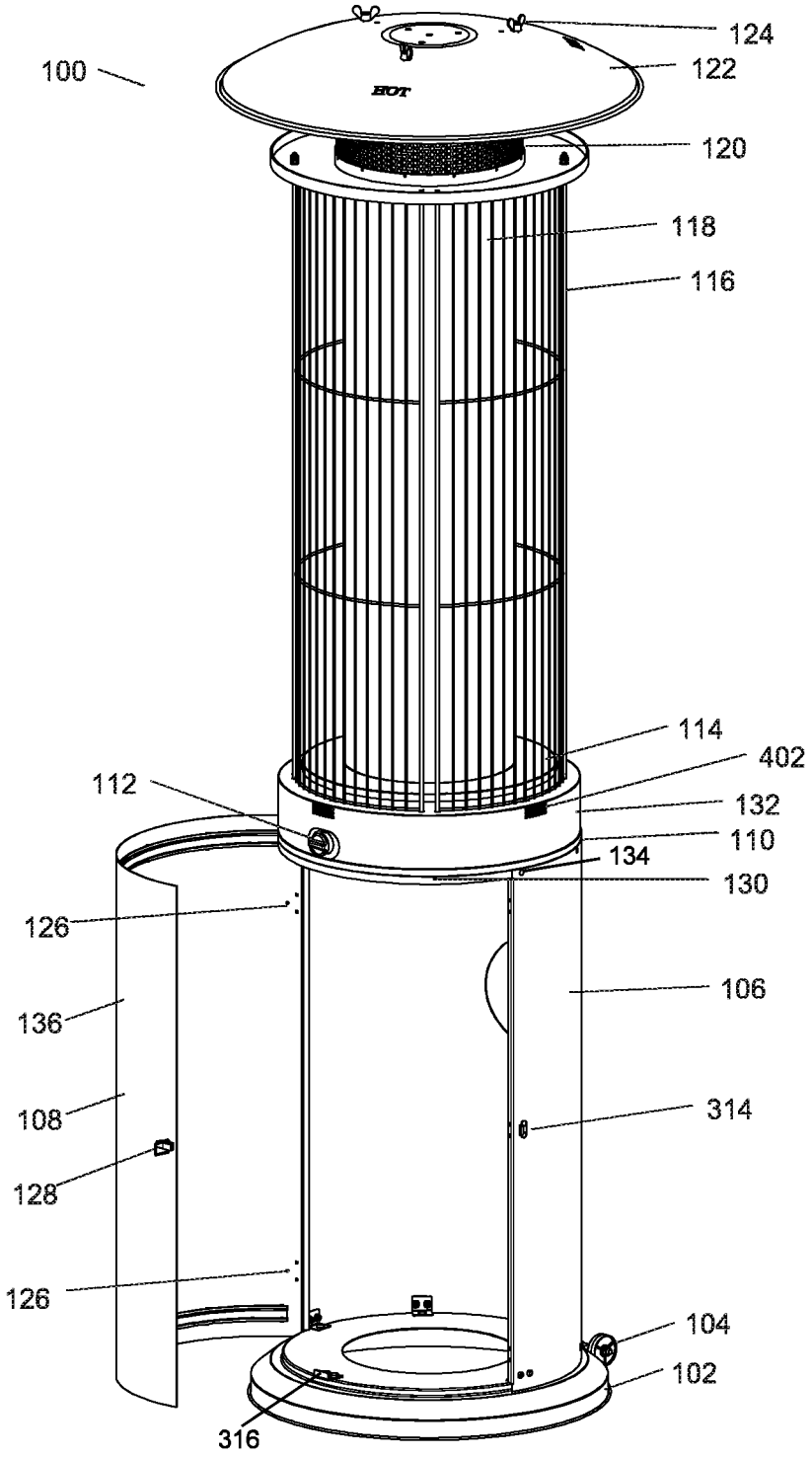
FIG. 1 illustrates a perspective view of the present invention with its door in an open position.

FIG. 1 shows a completely assembled twirling flame heater 100. It includes a base 102, a set of transport wheels 104; a supporting body 106; an arc shape door 108; a central mechanism 110; a control knob 112; a setter 114; a protective cage 116; a transparent tube 118; a heat concentrator 120 and a heat shield 122, a door latch 128, a hinge mount set 126, and a hook 314.

Figure 2:
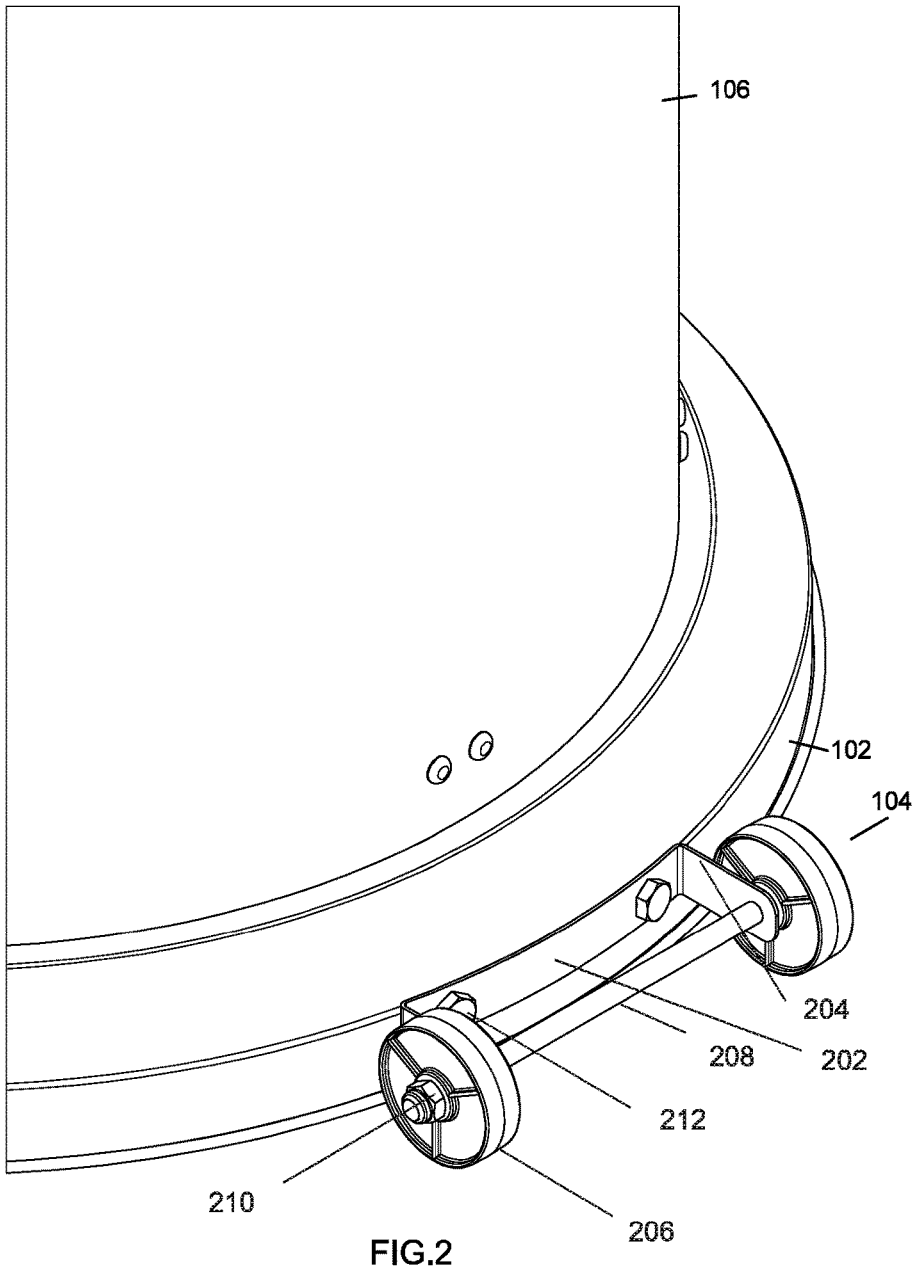
FIG. 2 shows wheel mechanisms making the present invention transportable.

FIG. 2 shows detail mechanisms of transporting wheels on the side of the base. The set of transport wheels 104 is secured to the base 102 via a bracket 202 with an arc that matches the arc of the round base 102. Both ends of bracket 202 are arms 204 with holes to accommodate a shaft 208. Arms 204 are of lengths greater than the radius of wheels 206 thus leaving equal distance gaps between surface of the base 102 and surface of wheels 206 making rotation of wheels 206 possible. Wheels 206 are retained by the presence of nuts 210 threadable secured to shaft 208. Bracket 202 is secured to based 102 by way of screws 212 with matching retaining nuts 214 on the interior side of based 102.

Figure 3:
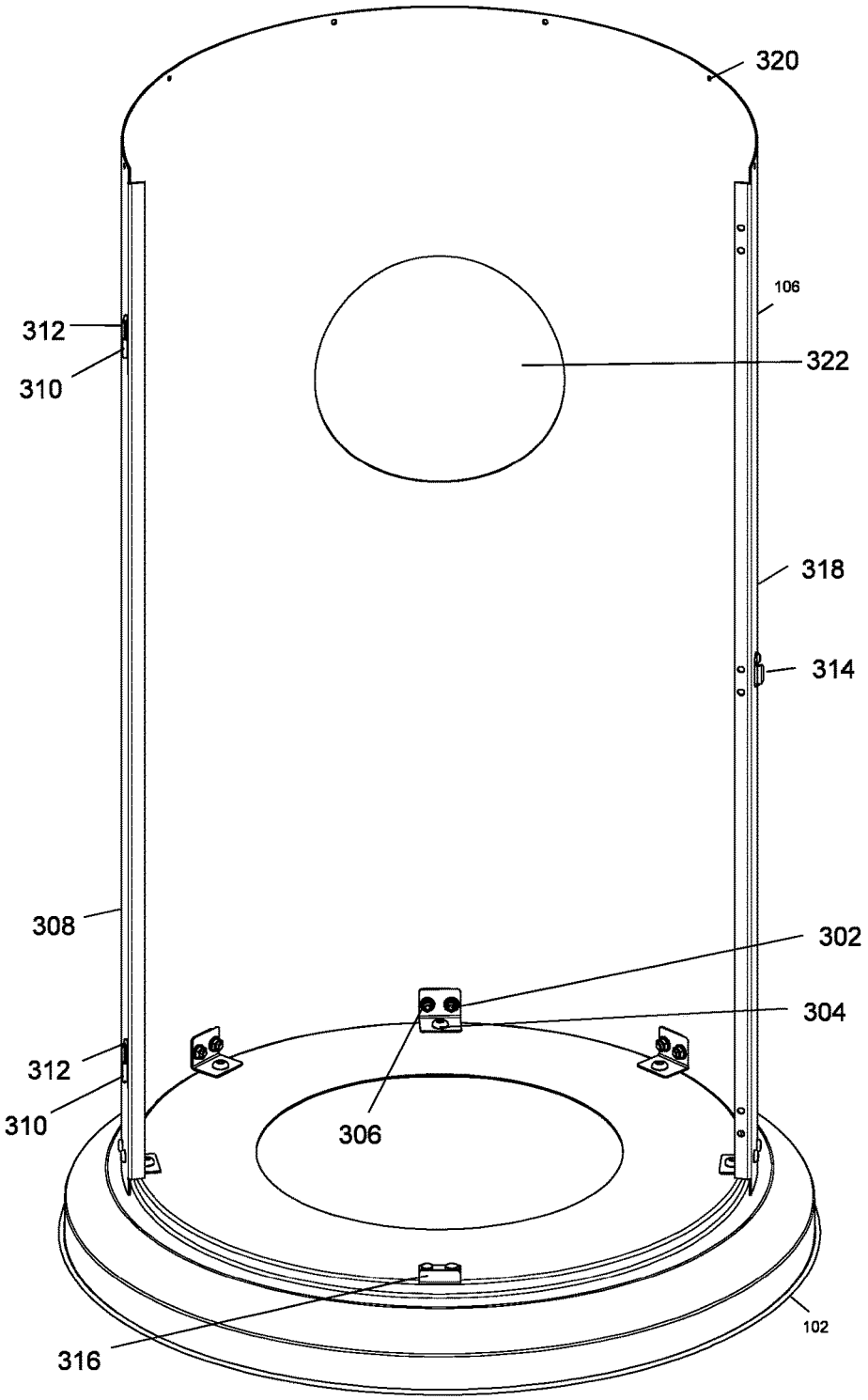
FIG. 3 shows how a body panel is affixed to the base of the present invention.

FIG. 3 shows a number of L-brackets 302 serving as the bridges that hold body 106 and base 102 together. A number of fastener set 304 secures the bracket 302 to the base 102 and a number of fastener set 306 secured the bracket 302 to the body 106. On edge 308 of body 106 are a pair of hangers 310 with upward pointing shafts 312. Shafts 312 are inserted into door hangers 126 forming a rotatable hinge allowing door 108 to swing open or closed about hinges 126. On edge 318 is a hook 314 complimentarily receive latch 128 to keep the door 108 closed and secured.

On the lower portion of the central mechanism 110 is a ridge 130 situated below main surface 132 yet above lip 134. On the lip 134 are a number of holes complementary to holes 320 of the body 106. As the central mechanism 110 is placed on top of body 106 whereby the holes on lip 134 aligns with holes 320 of body 106, a set of fasteners may fasten the lip 134 and body 106 together. Once the fasteners are tightened, ridge 130 rests nicely on the top rim of body 106 jointly bearing the full weight of any parts resting there-above. On top of base 102 is an adjustable door stopper 316 that can be adjusted either inward or outward to accommodate door 108 so that the perimeter of door 106 can be flushed with the edge 308 and edge 318.

Figure 4C:
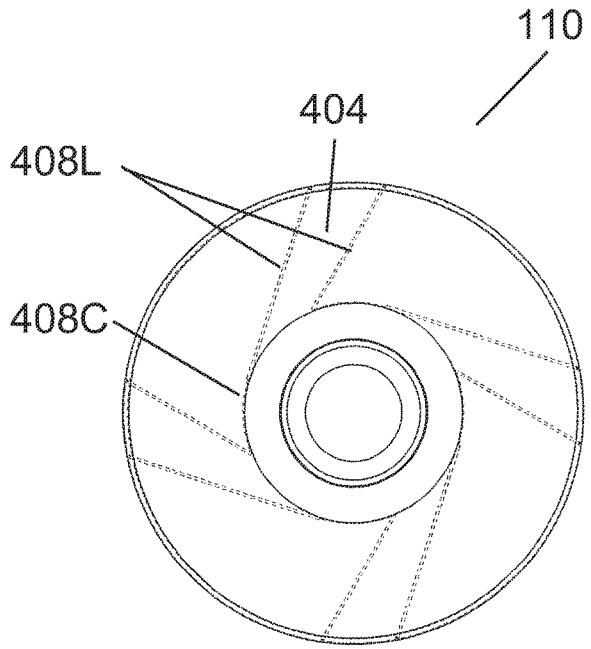
FIG. 4C shows a top exposed view of the central mechanism of the present invention.
Figure 4A:
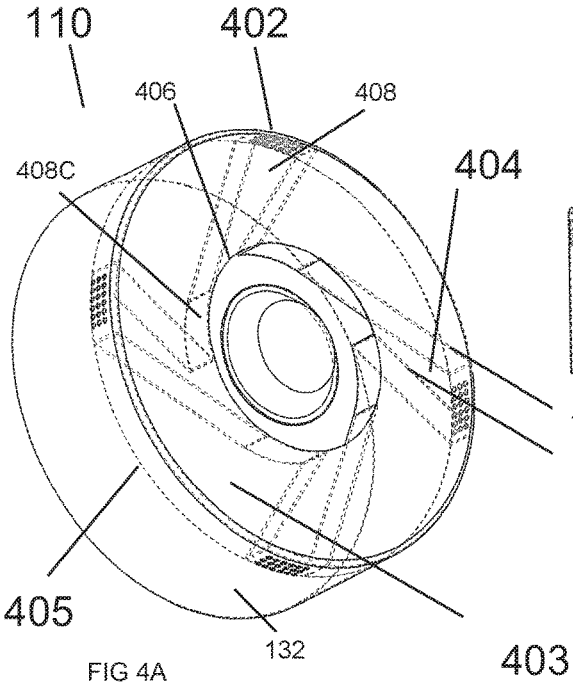
FIG. 4A shows a perspective and exposed view of a central mechanism of the present invention.

FIG. 4A is a perspective exposed view of central mechanism 110. There are two surface layers, a top layer 403 and a sub-layer 405. Numerous air inlets 402 are located at selected areas of surface 132. Numerous air channels 404 are behind air inlets 402. Air outlets are shown as angle entry outlets 406. Segments of lip 8C, 408L and 408L' are shown on the central mechanism 110, together forming air channels 404. As shown, a portion of each segment is located along the edge following the curvature of the interior circle designated as 408C and a portion of each segment extends linearly to the interior side of surface 132 designated as 408L and 408L'.

Figure 4B:
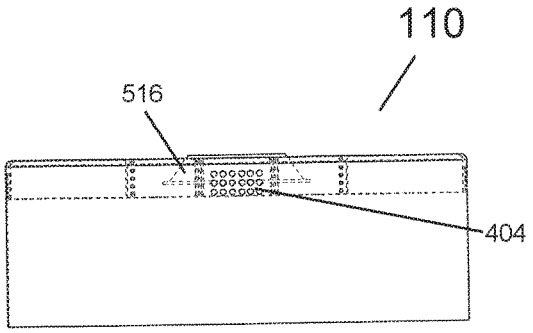
FIG. 4B shows a side exposed view of the central mechanism of the present invention.

FIG. 4B shows a side exposed view of the central mechanism 110 and the layout of inlet 404 and gas distributor 506.

FIG. 4C shows a top exposed view showing the layout of the air channels 404.

Figure 4D:
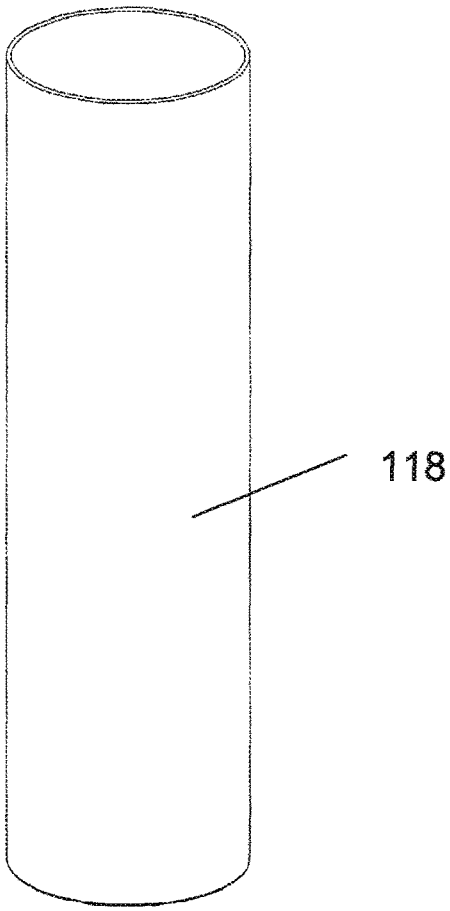
FIG. 4D shows a transparent glass tube of the present invention.

FIG. 4D shows a glass tube 118 within which a twirling flame is lit.

Figure 4E:
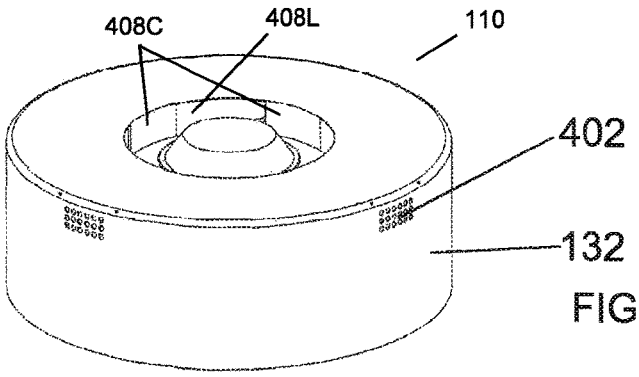
FIG. 4E shows a perspective view of the central mechanism of the present invention.

FIG. 4E shows a perspective view of central mechanism 110 illustrating from a side angle 408C and 408L.

Figure 5:
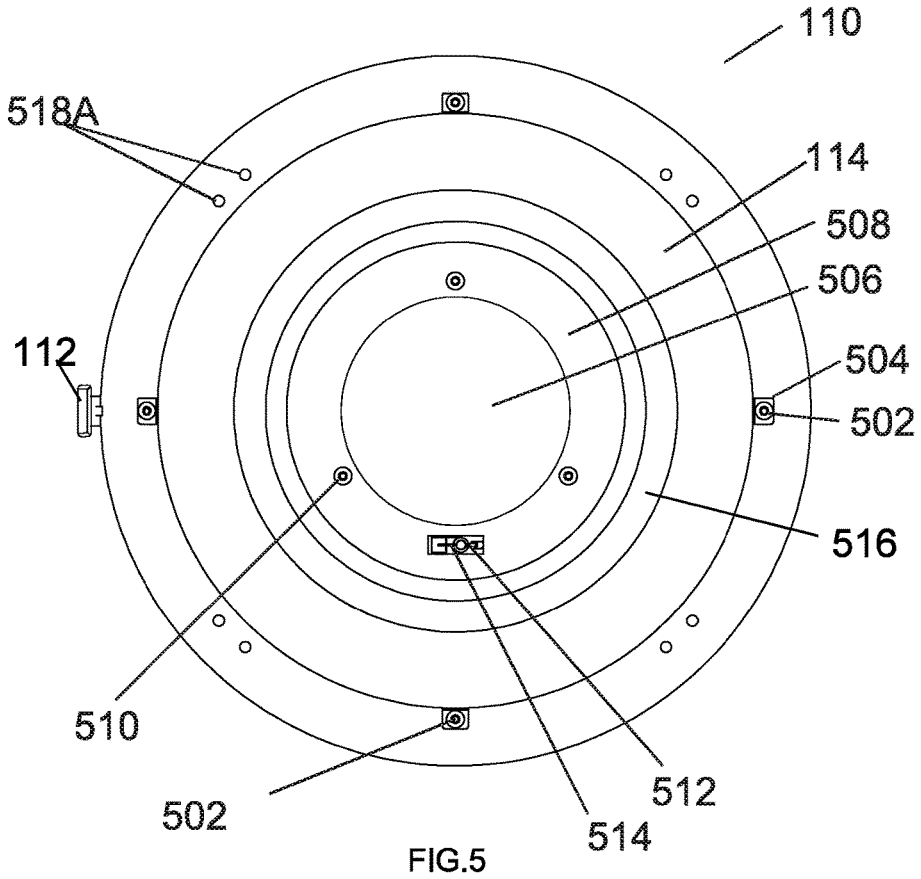
FIG. 5 shows a top view of the central mechanism of the present invention.

FIG. 5 is a top view of the central mechanism 110. It shows a setter 114 fastened to the central mechanism 110 via a set of fasteners 502 located at locations along four quadrants. Once fastened, the setter 114 is raised by a set of legs 504 above the top surface of the central mechanism 110. Also shown is a gas distribution chamber 506 and its base plate 508. A set of fasteners 510 are used to hold the burner 506 to the central mechanism 110.

Figure 6A:
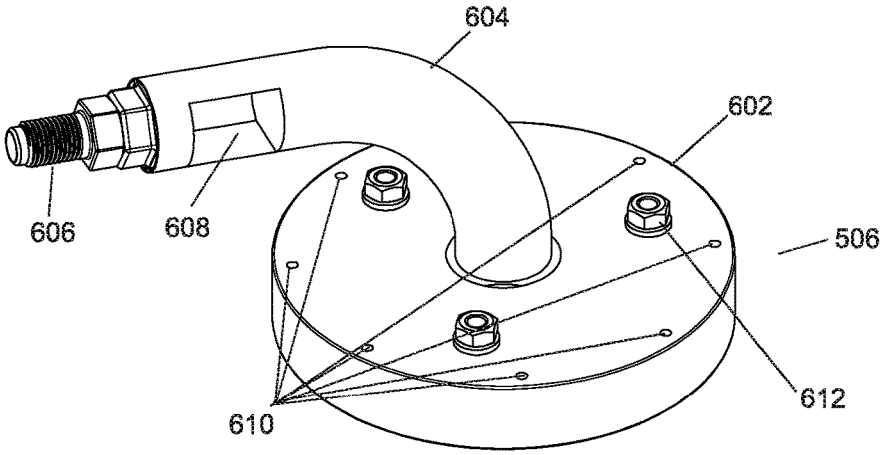
FIG. 6A shows a perspective and bottom view of the gas distributor of the present invention.
Figure 8:
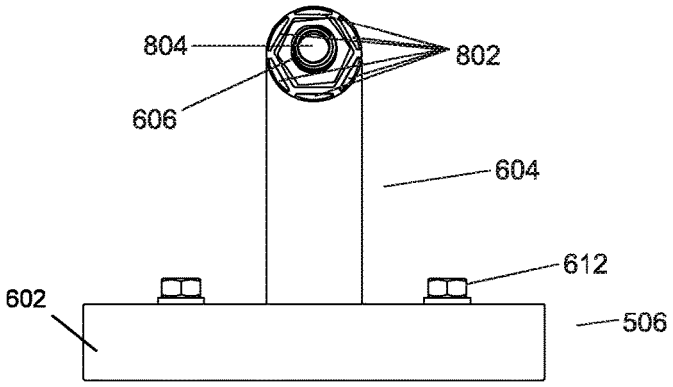
FIG. 8 shows another side view of the gas distributor of the present invention.

FIG. 6A shows an underside of the gas distributor 506. It has a chamber 602 connected to a gas tube 604 and connected to a male gas adapter 606, respectively. A set of openings 608 is situated on both side of gas tube 604. The junction where the male gas adapter 606 is connected to the end of the gas tube 604 are a set of openings 802 as shown in FIG. 8. The purpose of openings 608 and 802 is suctioning in oxygen by venturi effect when combustible gas is injected under pressure. Upon mixing combustible gas with oxygen within chamber 602, the final mixture is let out via a set of gas distribution holes 610. Given openings 608 and 802 are all located underneath the central mechanism 110, the ambient air is drawn from open air communication between the interior chamber of body 106 via a body opening 322 and a door opening 136.

Figure 7:
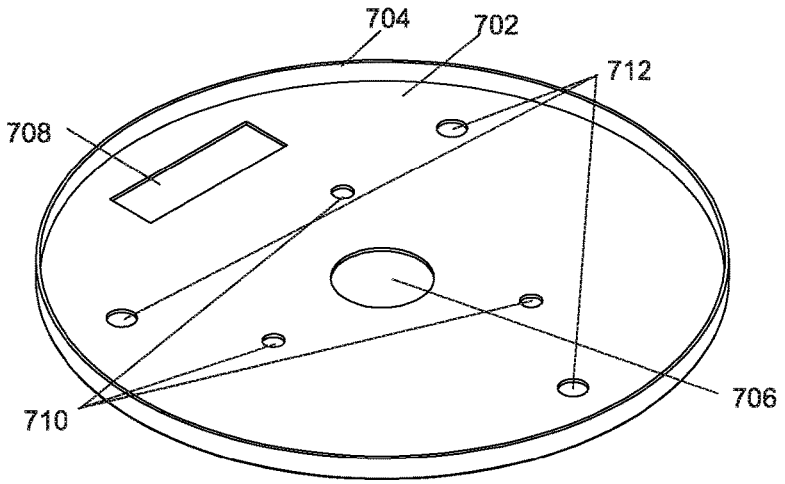
FIG. 7 shows a perspective and bottom view of the gas distributor mounting plate of the present invention.

FIG. 7 shows the underside of a mounting plate 702 with a flange 704, a central hole 706, a rectangular opening 708, a set of inner mounting holes 710 and a set of outer mounting holes 712. The mounting plate 702 is installed onto the gas distributor 506 by inserting the gas tube 604 into central hole 706 and by aligning the inner holes 710 with a set of surface mount nuts 612 then insert a set of fasteners 714 to fasten the mounting plate 702 onto the gas distributor 506. The set of surface mount nuts 612 concurrently serves as the spacers to maintain a proper gap between the mounting plate 702 from the gas distributor 506 to allow gas to escape from gas distribution holes 610. The flange 704 is of sufficient height to accommodate the height of screw heads of the set of fasteners 714.

Figure 6B:
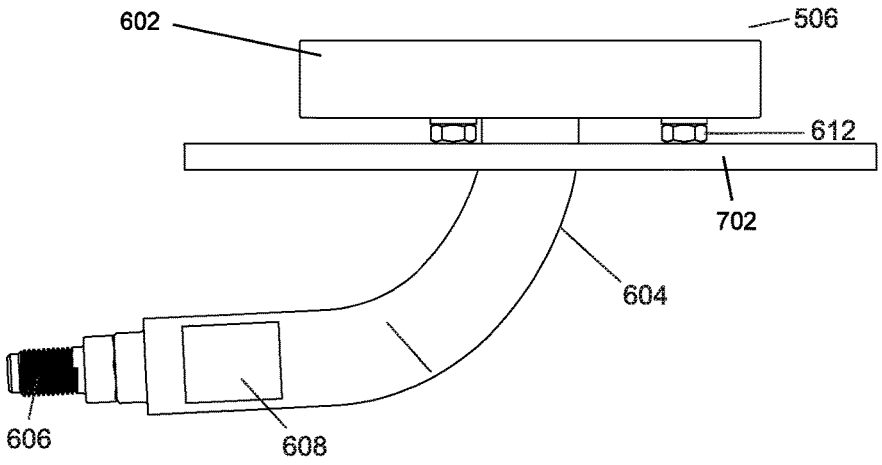
FIG. 6B shows a side view of the gas distributor of the present invention.

FIG. 6B shows a side view after the mounting plate 702 is fully installed onto the gas distributor 506.

FIG. 8 shows a frontal view of the male gas adopter 606 with a combustible gas channel 804. Surrounding the combustible gas channel 804 are a set of surrounding air inlets 802 for oxygen intake. When combustible gas under pressure is injected into the combustible gas channel 804, oxygen from ambient environment is suctioned via the surrounding air inlets 802 and the set of openings 608 by venturi effect.

Figure 9:
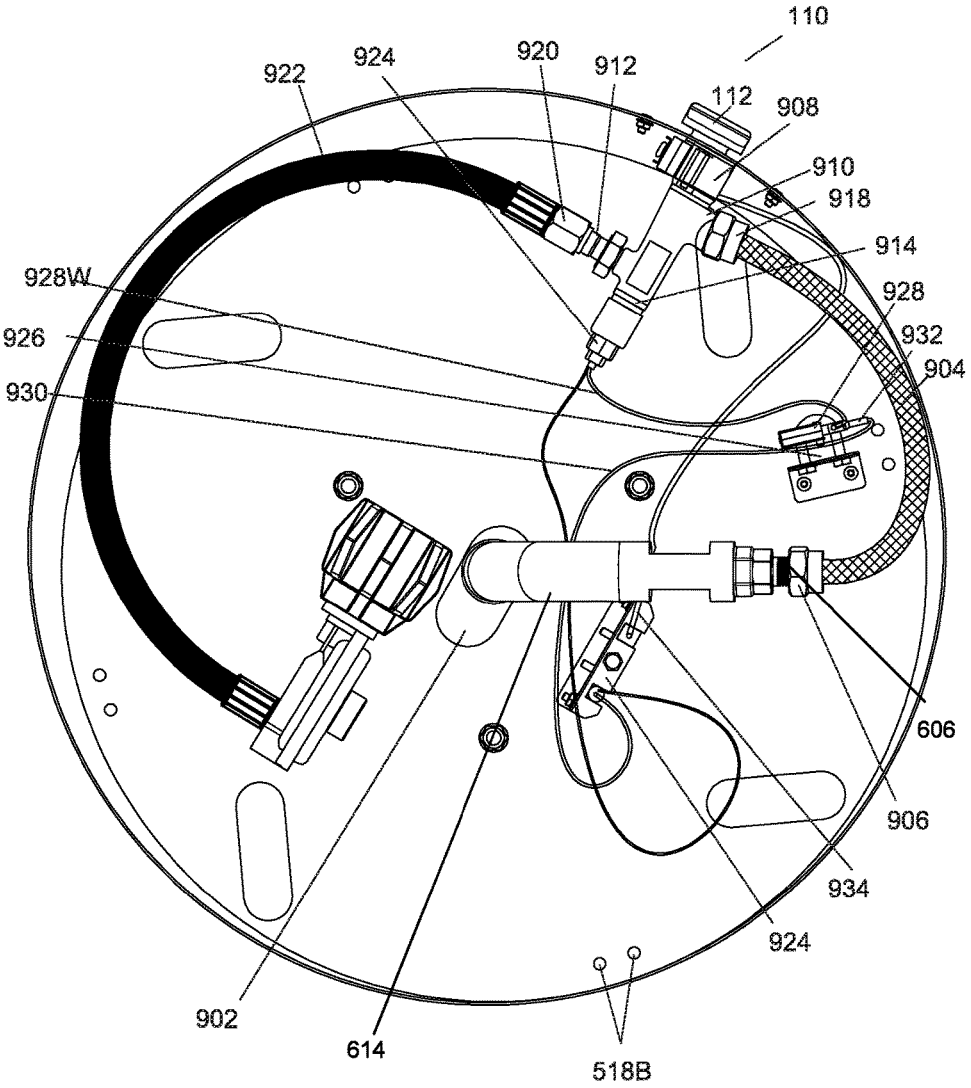
FIG. 9 shows a bottom view of the central mechanism of the present invention.

FIG. 9 shows an underside view of the central mechanism 110. It shows an elongated elliptical opening 902 to allow the gas tube 604 to pass there-through. It shows a flexible tube 904 one end of which is a first female adapter 906 receivably connected to the male adapter 606.

A main controller 908 with a first male adapter 910, a second male adapter 912, a third male adapter 914 and a control knob 112. The first male adapter 910 is connected to a second female adapter 918. The second male adapter 912 is connected to a main flexible gas line 922 via a female adapter 920. The main flexible gas line 922 is connected to a tank of combustible gas supply, such as a propane tank.

A spark module 924 is mounted on the underside of the central mechanism 110. A bump safety switch 926 is also mounted on the underside of the central mechanism 110. A first wire 928W initiated from a female adapter 924 receivably connected to the male adapter 914 is connected to a first terminal 928 of the bump safety switch 926. A second wire 930 initiates from a second terminal 932 is connected to a hot side of the spark module 924. A third wire 934 connected to the cold side of the spark module 924 is connected to the main controller 908.

The bump safety switch 926 makes a connection between terminals 928 and 932 only when the twirling flame heater 100 stands in its upright position. When the ignitor within the main controller 908 is initiated via knob 112, a sparks appears between the hot terminal 514 and the cold terminal 512. Should the twirling flame heater 100 be toppled for any reason, the bump safety switch 926 internally causes a disconnection between terminals 928 and 932 thus an open circuit. Hence, even if the ignitor within the main controller 908 is initiated for any reason, a spark would not be produced to ensure safety.

A cylindrical glass tube 118 is insertable set into setter 114 and rest on top of landing 516. On the outer skirts of a top layer 403 of the central mechanism 110 are a set of holes 518A. A set of matching holes 518A shown in FIG. 5 are at the same locations on the sublayer 405 shown as holes 518B in FIG. 9.

Figures 10A, 10B:
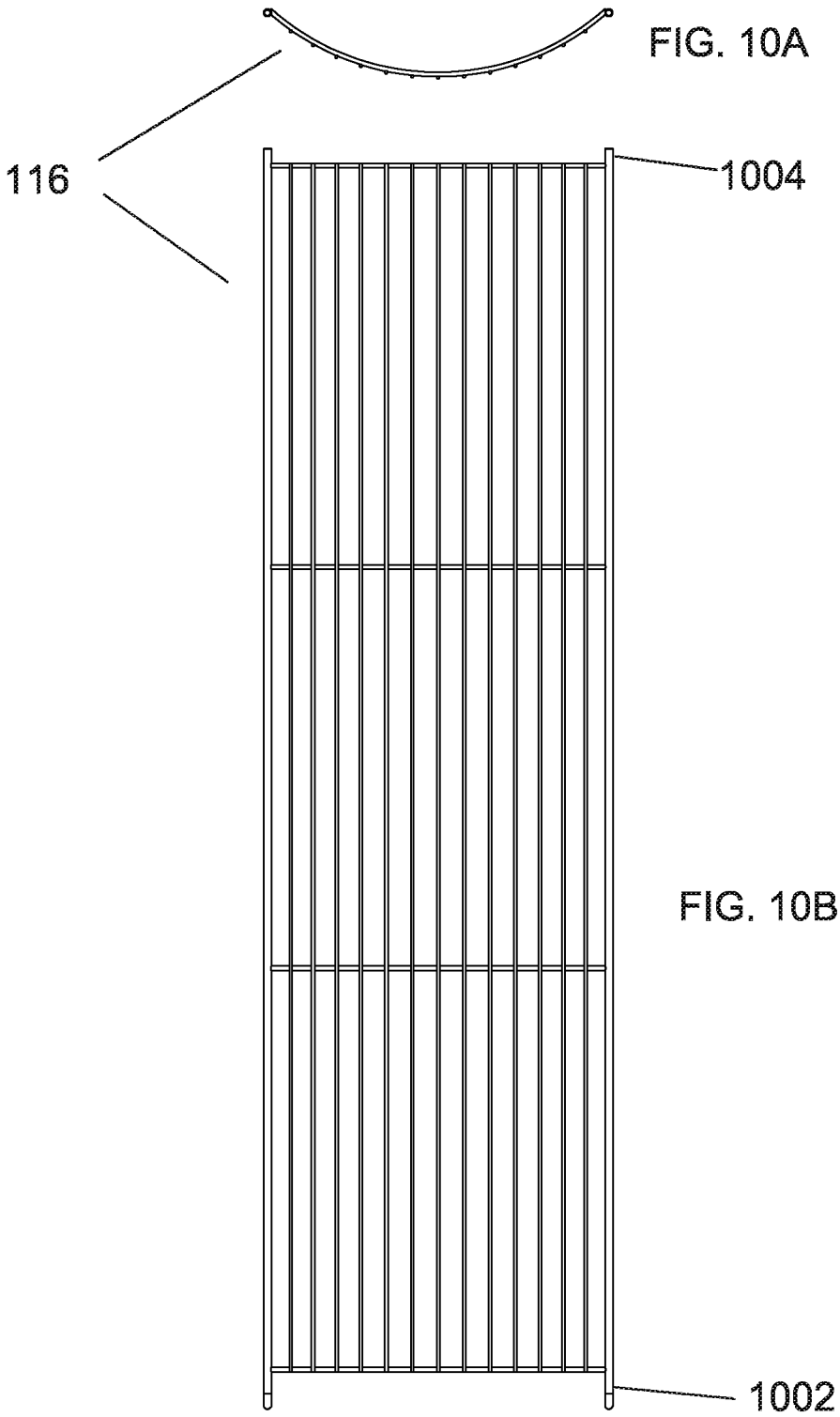
FIG. 10A shows a top view of a cage quadrant of the present invention.
FIG. 10B shows a side view of a cage quadrant of the present invention.

FIG. 10A shows one of four quadrants when all put together form the cage 116. Each quadrant has long stem ends 1002 and a short stem ends 1004 as shown in FIG. 10B. Long stem ends are inserted into holes 518A and 518B to be fastened by a set of nuts.

Figure 11:
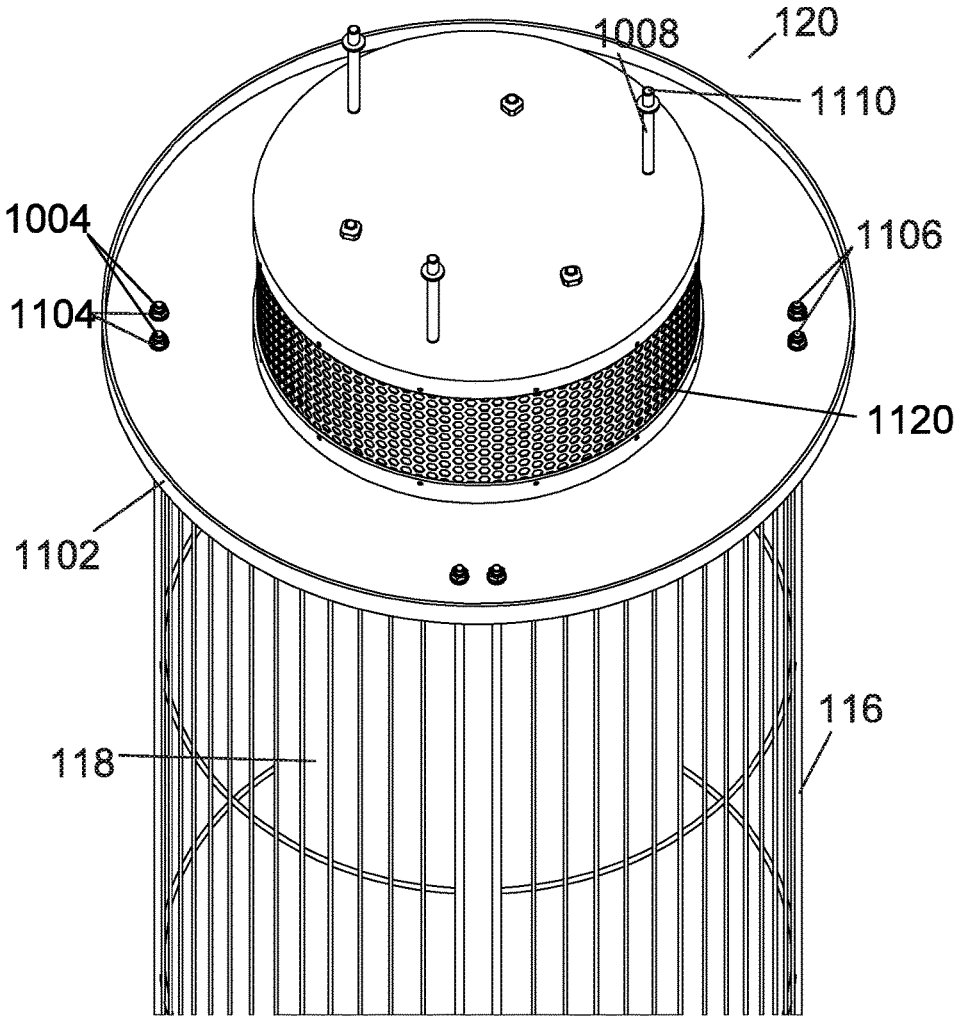
FIG. 11 shows a top view of a heat concentrator with its mounting plate of the present invention.

FIG. 11 shows the heat concentrator 120 with a mounting platform 1102 each containing a set of holes 1104 upon which short end stems 1004 may pass there-through to receive a set of nuts 1106. The complete fastening of which would show a fully formed cage 116.

Figure 12:
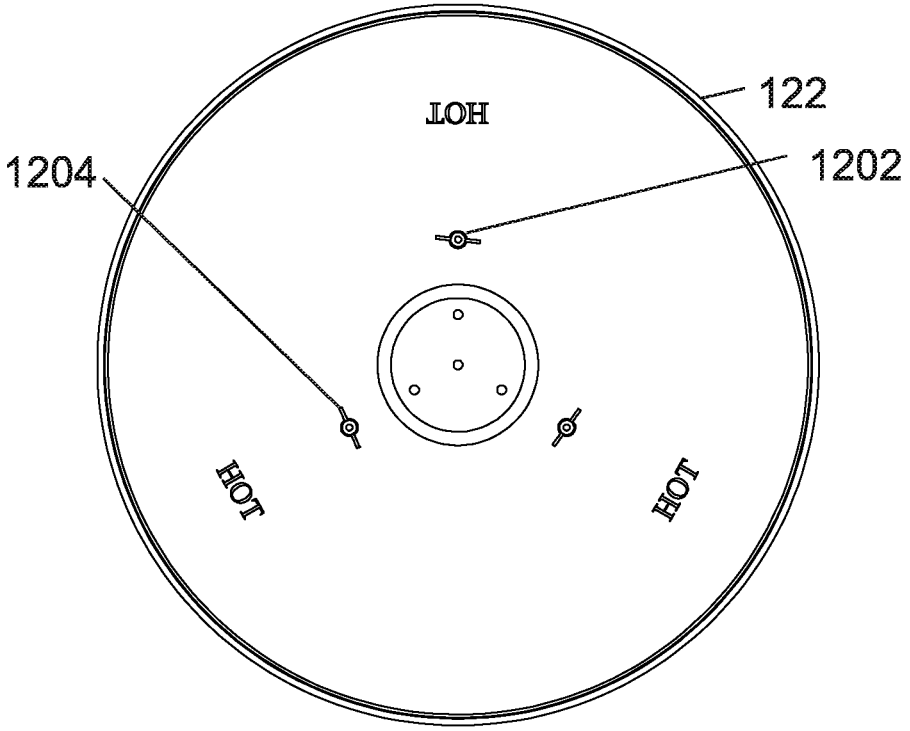
FIG. 12 shows a top view of the heat shield of the present invention.

A set of spacing studs 1108 are mounted on the heat concentrator 120. Top threaded ends 1110 are to penetrate a set of holes 1202 to be fastened by a set of wingnuts 1204, as shown in FIG. 12.

Figure 13:
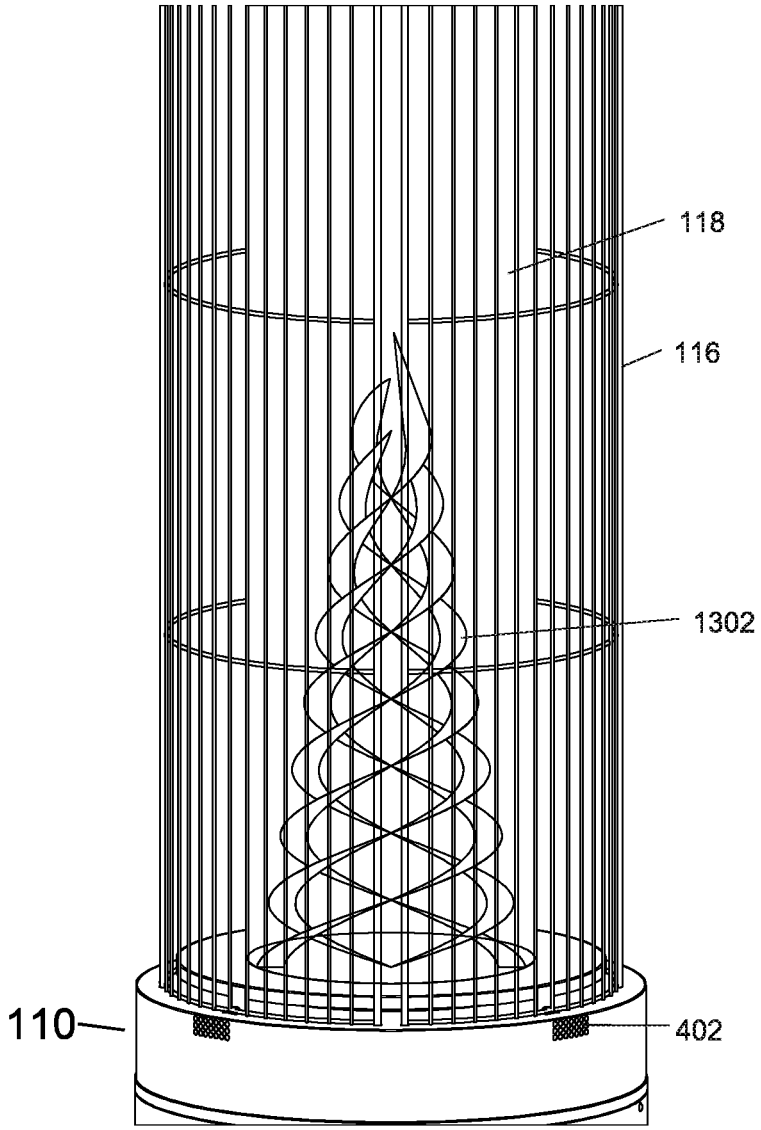
FIG. 13 shows a twirling flame produced by the present invention.
Figure 14:
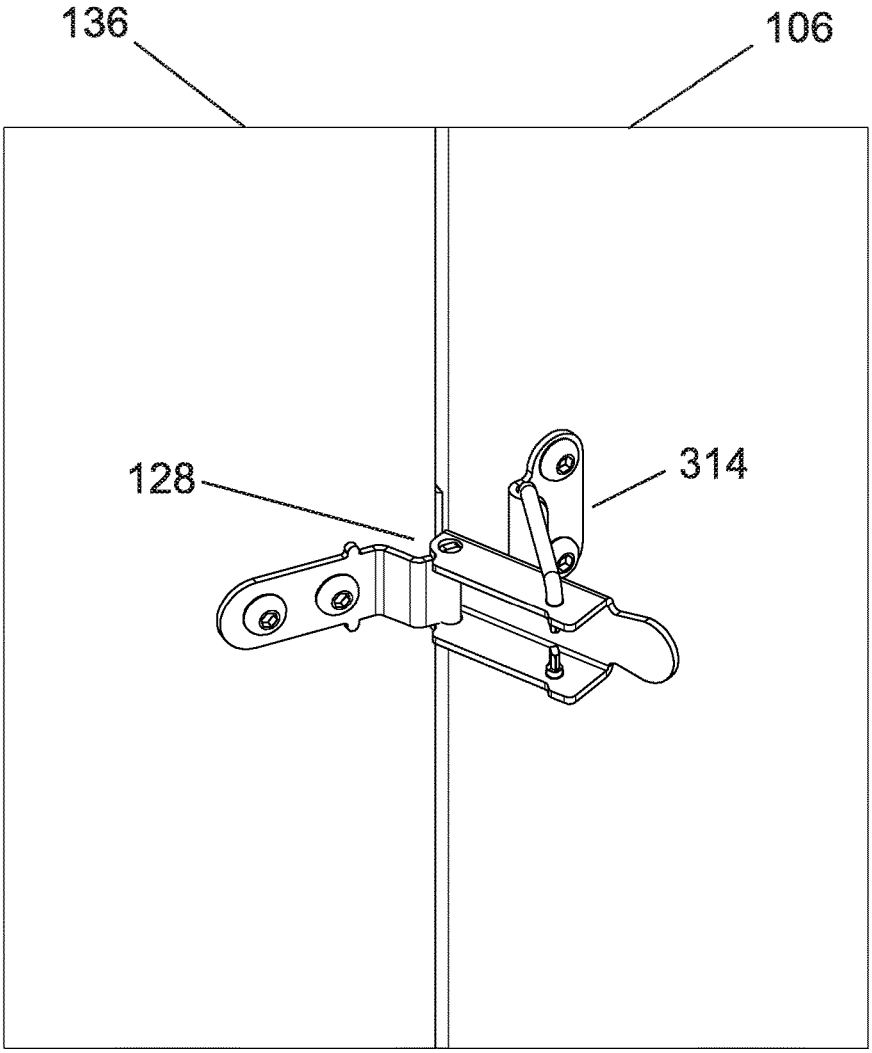
FIG. 14 shows a door hook and latch of the present invention.

In operation, one would turn the control knob 112 which will allow combustible gas from a tank under pressure to pass through combustible gas channel 804 into the gas tube 604 sucking by venturi effect oxygen from openings 802 and 608 producing a mixture in chamber 602. The mixture is distributed via gas distribution holes 610. A spark is produced between hot terminal 512 and cold terminal 514 to ignite the mixture. Once the mixture is ignited, hot air in the glass tube 118 rises thus creating a suctioning effect to draw oxygen from the ambient environment via the air channels 404. Given the ambient air being suctioned into the glass tube 118 via a set of angle entries 406 which enters in directions perpendicular to the rising direction of the flame. Hence, by the suctioning action of the rising hot air and perpendicular air intake via the angle entries 406, a naturally aspirated circular air turbulence is created in the glass tube 118 and that air turbulence turns what otherwise be a normal flame into a twirling flame, creating both a thorough burn through air turbulence and an intriguing flame 1302 mesmerizing to the viewer, as shown in FIG. 13. The hot air rises within the glass tube 118 into the heat concentrator 120 and radially gush upwardly and outwardly via radial openings 1120. As the heat shield 122 is of a parabolic shape, heat waves reaching the heat shield would then be parabolically reflected downwardly and outwardly into the ambient environment.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The inventions defined solely by the appended claims including any amendments made during the pendency of this application and all equivalents of those claims as issued.

What is claimed is:

1. A heater with a twirling flame, comprising:

a glass tube with a vertical flow path;

a central mechanism with a gas distributor distributing combustible gas into the glass tube;

an ignitor installed on the central mechanism with igniting terminals communicably disposed in the vertical flow path of the glass tube;

a plurality of air channels with a plurality of horizontal flow paths in the central mechanism wherein the horizontal flow paths are communicably connected to the vertical flow path of the glass tube;

wherein upon igniting a spark between the igniting terminals, the combustible gas combusted into a flame generating a heat wave in the glass tube; and wherein the heat wave rises along the vertical flow path and air enters from the plurality of air channels along the plurality of horizontal flow paths into the glass tube to create a flow turbulence producing the twirling flame; and further comprising:

a gas distributor including a gas distribution tube and a gas distribution chamber; and a mounting plate;

wherein the gas distributor is fastened to the mounting plate; and wherein the gas distributor is fastened to the central mechanism via the mounting plate and the gas distribution tube penetrates through both the top layer and the sublayer via a set of openings.

2. The heater of claim 1, wherein the central mechanism further comprises:

a chamber formed by a circular top layer with a center circular opening, and a circular sublayer both surrounded by a cylindrical exterior surface.

3. The heater of claim 2, wherein the central mechanism further comprises:

a plurality of groups of air inlet openings on the cylindrical exterior surface spaced equal distance apart.

4. The heater of claim 3, wherein the central mechanism further comprises:

a plurality of air outlet openings on a cylindrical interior surface spaced equal distance apart.

5. The heater of claim 4, wherein the central mechanism further comprises:

a plurality of air channels in the chamber each formed by a first divider and a second divider allowing air communication between one of the plurality of groups of air inlet openings with one of the plurality of air outlet openings.

6. The heater of claim 5, wherein the central mechanism further comprises:

a first curved portion; and a first linear portion;

wherein a junction where the curved portion and the linear portion meet forms an obtuse angle.

7. The heater of claim 6, wherein the central mechanism further comprises:

a second curved portion; and a second linear portion;

wherein a second junction where the second curved portion and the second linear portion meet forms an acute angle.

8. The heater of claim 1, further comprising:

an ignitor module with a first terminal and a second terminal;

wherein the ignitor module is fastened underneath the sublayer but the first ignite terminal and second ignite terminals are situated above the sublayer.

9. The heater of claim 1, further comprising:

a bump safety switch with a first terminal and a second terminal;

wherein the bump safety switch is fastened underneath the sublayer.

10. The heater of claim 1, further comprising:

a central control module with a control knob, a first gas terminal, a second gas terminal and an electrical terminal;

wherein the central control module is fastened underneath the sublayer whereby the control knob is situated outside an exterior surface of the central mechanism.

11. The heater of claim 10, further comprising:

a gas tube connected between the first gas terminal and the gas distribution tube.

12. The heater of claim 11, further comprising:

a main gas line connected between the second gas terminal and a gas supply.

13. The heater of claim 12, further comprising:

a first wire connected between the electrical terminal of the central control module and the first terminal of the bump safety switch.

14. The heater of claim 13, further comprising:

a second wire connected between the second terminal of the bump safety switch and the first ignite terminal of the ignitor.

15. The heater of claim 14, further comprising:

a spark control mechanism located in the main control;

wherein upon initiating a spark from the spark control mechanism, a spark appears between the first ignite terminal and the second ignite terminal of the ignitor provided the heater stands upright and no spark appears between the first ignite terminal and the second ignite terminal should the heater not standing upright.

16. The heater of claim 1, further comprising:

a heater body;

a door; and a set of wheels;

wherein the heater body sustains the control mechanism;

wherein the door is mounted to the heater body able to be open and close; and wherein the set of wheels is mounted to the base of the heater.

17. The heater of claim 1, further comprising:

a heat concentrator;

a mounting plate with a central opening; and a plurality of cage segments with upper connectors and lower connectors;

wherein the mounting plate is fastened to the heat concentrator forming a heat dispenser;

wherein the plurality of cage segments is fastened to the central mechanism via the lower connectors;

wherein the plurality of cage segments is fastened to the mounting plate via the upper connectors and an upper portion of the glass tube fits into the central opening of the mounting plate.

18. The heater of claim 17, further comprising:

a heat shield; and a plurality of height stems;

wherein the plurality of height stems is mounted on the heat dispenser and the heat shield is m mounted on the height stems.

19. A heater with a twirling flame, comprising:

a glass tube with a vertical flow path;

a central mechanism with a gas distributor distributing combustible gas into the glass tube;

an ignitor installed on the central mechanism with igniting terminals communicably disposed in the vertical flow path of the glass tube;

a plurality of air channels with a plurality of horizontal flow paths in the central mechanism wherein the horizontal flow paths are communicably connected to the vertical flow path of the glass tube;

wherein upon igniting a spark between the igniting terminals, the combustible gas combusted into a flame generating a heat wave in the glass tube; and wherein the heat wave rises along the vertical flow path and air enters from the plurality of air channels along the plurality of horizontal flow paths into the glass tube to create a flow turbulence producing the twirling flame; and further comprising:

a heat concentrator;

a mounting plate with a central opening; and a plurality of cage segments with upper connectors and lower connectors;

wherein the mounting plate is fastened to the heat concentrator forming a heat dispenser;

wherein the plurality of cage segments is fastened to the central mechanism via the lower connectors;

wherein the plurality of cage segments is fastened to the mounting plate via the upper connectors and an upper portion of the glass tube fits into the central opening of the mounting plate.

* * * * *